United States Patent [19]

Kennedy

[11] 4,435,168

[45] Mar. 6, 1984

[54] CENTRIFUGE ROTOR APPARATUS WITH SLING ARMS

[75] Inventor: A. Terence Kennedy, Walpole, Mass.

[73] Assignee: Damon Corporation, Needham Heights, Mass.

[21] Appl. No.: 384,899

[22] Filed: Jun. 4, 1982

[51] Int. Cl.[3] ..... B04B 5/02

[52] U.S. Cl. ..... 494/20

[58] Field of Search ..... 494/16, 17, 18, 19, 494/20, 33, 34, 46, 83; 403/157, 158, 159; 384/282; 308/56, 59, 53

[56] References Cited

U.S. PATENT DOCUMENTS

| | | | |
|---|---|---|---|
| 760,416 | 5/1904 | Brammer | 403/157 |
| 1,746,129 | 2/1930 | Robinson, Jr. | 308/57 |
| 3,743,174 | 7/1973 | Drucker | 494/20 |
| 4,009,824 | 3/1977 | Wright | 494/20 |
| 4,148,433 | 4/1979 | Bayley | 494/20 |

*Primary Examiner*—Robert W. Jenkins

*Attorney, Agent, or Firm*—Lahive & Cockfield

[57] ABSTRACT

Centrifuge rotor apparatus for supporting centrifuge carriers by way of pivoting supports has sling-like rotor arms, each with vertically-spaced upper and lower arm segments joined at a sling seat distal from the rotor hub. Each rotor arm has a channel-like space between the arm segments which removably and replaceably receives carrier-supporting pivot structure and seats the pivot structure within a bearing formed at the sling seat.

10 Claims, 8 Drawing Figures

CENTRIFUGE ROTOR APPARATUS WITH SLING ARMS

BACKGROUND

This invention relates to centrifuge rotor apparatus. More particularly, the invention provides centrifuge rotor apparatus which mounts a centrifuge carrier secure against accidental dislodgement and which distributes centrifugally-generated forces to minimize stress concentrations. The invention provides improvements in centrifuge safety and economy.

A centrifuge commonly has a driven vertical shaft which carries a centrifuge rotor assembly. The assembly has a rotor fastened on the shaft for rotation therewith. The rotor supports carriers for containing or otherwise supporting the material and articles to be centrifuged. The centrifuge carriers commonly are readily removable and replaceable to facilitate cleaning and loading, as well as interchange for centrifuging different materials and articles. The centrifuge carrier can be a single structure that forms a specimen receptacle or other holder and that pivotally attaches to the rotor. An alternative construction employs a trunion device that pivotally attaches to the rotor and that supports a removable and replaceable specimen holder. With either construction, the pivotal attachment of the carrier to the rotor conventionally is by way of trunion pins that seat in vertical slots. However, a construction in which the slots recess the rotor suffers from undesirable stress concentrations in the slot-forming rotor structure. A construction in which trunion pins project from the rotor suffers from the added circumferential space required on the carriers for forming the pin-receiving slots. Further, many forms of either construction suffer from the possibility of accidental dislodgement of the trunion pins from the slots; for example, during an abrupt change in rotor speed. Such accidental dislodgement and the aforesaid stress concentrations are potentially of significant danger in a centrifuge, inasmuch as the rotor assembly typically rotates at speeds between several thousand revolutions per minute to tens of thousands of revolutions per minute. Moreover, additional material for providing safe levels of strength, and additional radial size to accommodate the added structure, all add to the cost and size of a centrifuge and accordingly are undesirable.

An object of this invention therefore is to provide centrifuge rotor apparatus which mounts centrifuge carriers for pivotal rotation and for ready removal and replacement, but with high security against accidental dislodgement and, further, with a high distribution of centrifugally-generated stresses. Another object of the invention is to provide centrifuge rotor apparatus of the above character which is relatively compact in size.

It is also an object of the invention that the rotor apparatus be well suited for relatively low cost manufacture.

Other objects of the invention will in part be obvious and will in part appear hereinafter.

SUMMARY OF THE INVENTION

Centrifuge rotor apparatus according to the invention has a rotor which mounts at the rotor hub to the centrifuge shaft. Arms extending radially outward from the hub support the centrifuge carriers. Each rotor arm has vertically-spaced upper and lower arm elements that join at a location distal to the hub to provide a rigid sling-like structure. The sides of each arm are recessed, between the upper and lower arm elements, to form a radially-elongated channel, and the distal juncture of the arm elements includes a trunion bearing at the outer end of the channel. The bearing is slotted to communicate with the channel.

Each centrifuge carrier has a pair of outwardly projecting trunion pins, and attaches to the rotor by fitting the opposed trunion pins into the chanels of two adjacent arms. This is done by rotating the carrier to offset the trunion pins from a circumferential orientation, to admit the opposed pins into the two opposed channels. The carrier is then rotated to align the pins circumferentially relative to the rotor, and is moved radially outward to slide the pins along the channels and into the bearings at the outer ends of the channels.

The resultant engagement of the carrier pins with the rotor arms is secure against accidental dislodgement, particularly during centrifugal rotation because the only path for pin dislodgement is radially inward, along the channels. This direction is counter to the centrifugal forces.

Further, the foregoing configuration enables each arm to have a continuous sling-like band or strap of material to transmit centrifugal forces to the rotor hub with minimal stress concentration. The upper and lower arm segments and the bearing-forming segment at the radial distal juncture of the arm segments forms this sling configuration.

In one particular embodiment, the channels in each rotor arm extend through the full width of the arm and thereby form a slot in the vertical web that otherwise extends between the arm segments. The arm segments hence are separated from one another along the length of the channel. This slotted arm construction enables carriers to be assembled readily on a rotor of unusually small radial size, relative to the width of the carriers. One reason for the size advantage is that the slot in each arm accommodates, during the mounting of a carrier, trunion pin, but also a rim element of the carrier. Further, the slotted arm configuration allows an assembly tool or machine to spread the upper and lower arm segments apart sufficiently to admit a slotted sleeve-like bearing liner piece into the outer end of the arm slot. The spread of the arm segments is well within the material elastic limit. Hence, upon release of the spreading force, the arm segments return to a normal configuration with the bearing piece securely held in place under significant compressive forces.

Hence a rotor having this preferred structure has light weight, due to the absence of material at the webs of the rotor arms, i.e. in the space between the upper and lower arm elements. Further, the trunion bearing piece is readily installed, which facilitates both the initial manufacture of a rotor and subsequent bearing replacement.

The centrifuge rotor apparatus of the invention can also be viewed as having plural centrifuge carriers each of which has a rim element from which two diametrically-opposed pivot means elements outwardly project, and having a specimen holder carried by the rim element. The rotor element of the apparatus is radially recessed, e.g. by the spaces between the several pairs of circumferentially adjacent arms, with plural carrier seats. Each carrier seat has a pair of opposed radially-extending channel-like spaces dimensioned for seatingly and retainingly receiving therein opposite edges of the aforesaid rim element of a carrier positioned in that seat. Further, each such space forms a pivotal bearing surface closing the radially outer end of the channel-like space, for seatingly receiving one pivot element of the carrier positioned in that seat.

A centrifuge carrier for use with a rotor according to the invention can have numerous constructions that provide diametrically-opposed outwardly-projecting trunion pins. One preferred embodiment employs a trunion ring which supports a removable specimen holder. The trunion ring is a cylindrical collar from which the pins project outwardly. The holder can be a container that fits within the ring and that has an enlargement, such as an outwardly-projecting rim adjacent the upper end, which supportingly seats against the ring.

This carrier construction is readily fabricated at low cost with the high consistency in size and weight required for a dynamically-balanced centrifuge rotor assembly. Moreover, the trunion ring efficiently transmits stresses from the holder to the pins which mount the carrier to the rotor arms. The rotor assembly which the invention provides thus can be subjected to high centrifugal forces, and correspondingly can be centrifuged at high speeds, and yet provides such centrifugal strength in a radially compact space with a structure that is convenient to use.

The invention accordingly comprises the features of construction, combinations of elements, and arrangement of parts exemplified in the constructions hereinafter set forth, and the scope of the invention is indicated in the claims.

BRIEF DESCRIPTION OF DRAWINGS

For a fuller understanding of the nature and objects of the invention, reference should be made to the following detailed description and the accompanying drawings, in which.

DESCRIPTION OF ILLUSTRATED EMBODIMENT

Figure 1:
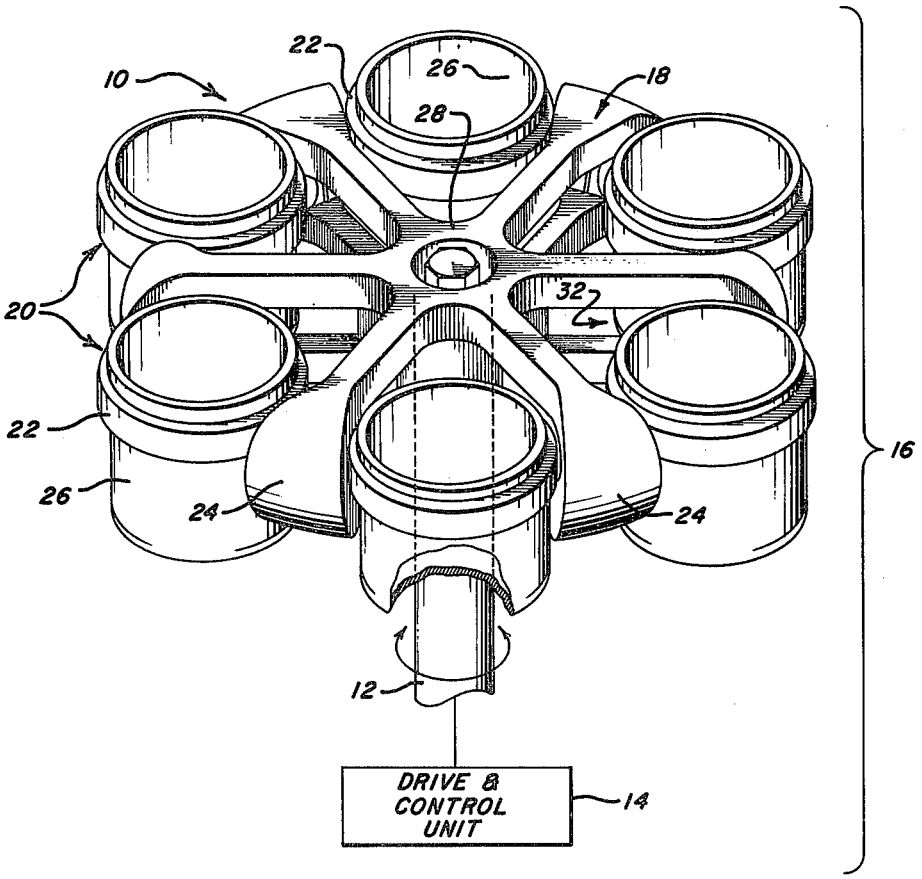
FIG. 1 is a schematic representation of a centrifuge fitted with a centrifuge rotor assembly according to the invention.

FIG. 1 shows a rotor assembly 10, shaft 12, and drive and control unit 14 of a centrifuge 16. The drive and control unit 14 controllably drives the shaft 12 to spin the rotor assembly 10 and thereby subject the material or articles which the rotor assembly carries to centrifugal forces. The drive and control unit 14 and the shaft 12 are of conventional design and construction. The centrifuge 16 further includes elements such as a housing or frame, and a protective enclosure for the rotor assembly 10, all as conventional, and which are omitted from the drawing for clarity of illustration.

With further reference to FIG. 1, the rotor assembly 10 has a rotor 18 mounted for rotation with the centrifuge shaft 12 and which supports a set of centrifuge carriers 20. Each illustrated centrifuge carrier 20 has a trunion ring 22 pivotally mounted between a pair of rotor arms 24, 24 and into which is fitted a centrifuge receptacle 26. The rotor arms 24 project radially outward from a rotor hub 28 which is centrally apertured to receive a threaded fastener and key for mountingly securing the rotor, and accordingly the rotor assembly 10, to the shaft 12. The rotor arms 24, 24 are arrayed symmetrically so that the rotor can be balanced dynamically, and circumferentially adjacent pairs of arms are arranged to receive between them and support one centrifuge carrier 20. The centrifuge carriers 20 are readily removed from the rotor and reassembled therewith.

Further, each centrifuge arm 24 has a pair of vertically-spaced, upper and lower arm elements **24*a* and 24*b*, respectively, and a bearing element 24*c* that joins the arm elements at their radially outer ends and that forms a bearing seat 24*f*. The arm elements 24*a* and 24*b* and bearing element 24*c* of each arm thus form a rigid radially-oriented sling structure with the arm elements forming the sling straps and the bearing element forming the sling seat, and with the inner ends of the sling straps secured to the rotor hub 28. The bearing seat 24*f*** of each rotor arm is thus located distal from the rotor hub.

Figure 3:
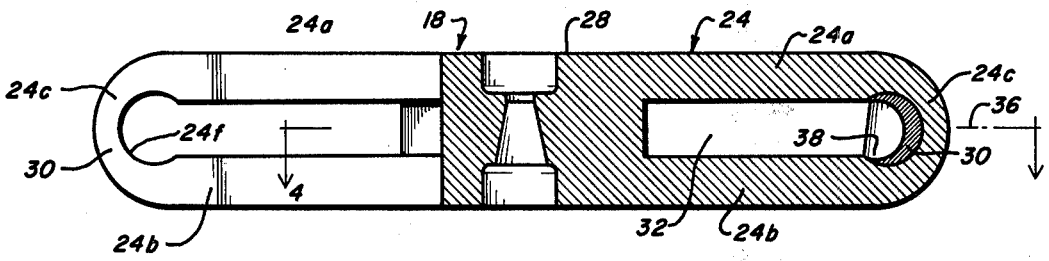
FIG. 3 is an elevational cross-sectional view of the rotor of FIGS. 1 and 2, taken along line 3—3 of FIG. 2.
Figure 4:
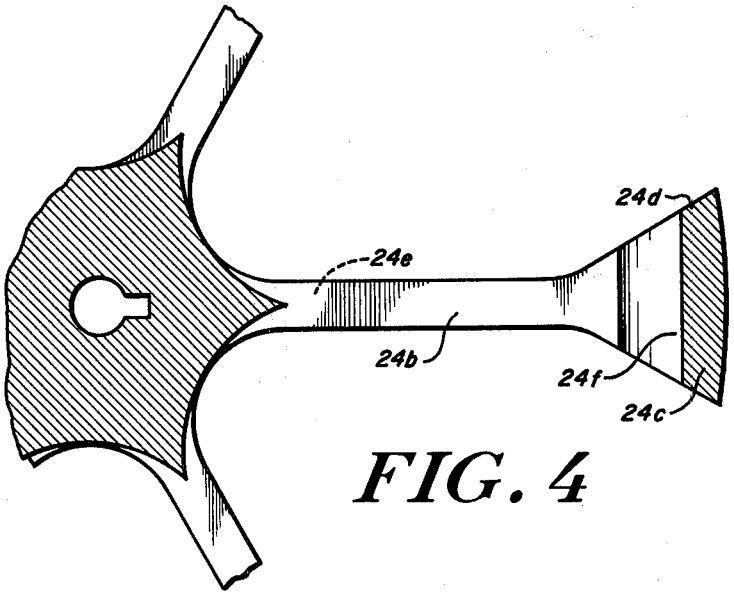
FIG. 4 is a fragmentary horizontal cross-sectional view of the rotor of FIGS. 1 and 2 taken along line 4—4 of FIG. 3.

As shown in FIGS. 3 and 4, each rotor arm is recessed between the arm elements thereof with a radially-extending channel. The bearing element **24*c* of the arm provides a trunion bearing at the outer end of the channel; in the illustrated construction a bearing liner piece 30 is seated in the arm to provide a hardened and replaceable bearing structure. The channel recesses the radially-extending vertical arm surface, which is the surface which faces the adjacent rotor arm. Thus each arm is recessed on two opposed surfaces with back-to-back channels. In the illustrated embodiment, the channels extend through the arm, i.e. through the web that would otherwise be centered along the arm center line 24*e* (FIG. 4) separating the arm elements. The channels thus form a slot 32 in the vertical space between the two arm elements 24*a* and 24*b***.

In the illustrated construction, each rotor arm 24 is of uniform height to the rounded outer end, as appears in FIG. 3. As appears in FIGS. 2 and 4, each rotor arm is of uniform width along the median section with a rounded juncture to the rotor hub. The arm width increases with a delta-like triangular flair at the outer end section **24*d*, for providing the bearing that seats the trunion pins of a carrier 20. The distance (d) noted in FIG. 2 between the end sections 24*d*, 24*d* of each pair of adjacent arms is related to a width dimension of a centrifuge carrier 20. For example, this dimension accepts between the arm end sections the outer diameter (without the trunion pins) of a trunion ring 22. As also shown in FIG. 3, the illustrated slot 32 in each arm is of uniform height along the length thereof except for a bearing-receiving enlargement at the outer end. The rotor 18** typically is machined with this construction of metal.

Figure 5:
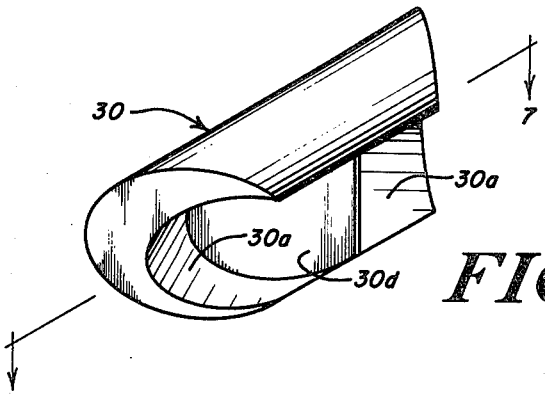
FIGS. 5, 6 and 7 show a trunion bearing piece for the rotor of FIGS. 1 and 2, and are respectively perspective, front elevation, and horizontal cross-sectional views thereof.
Figure 6:
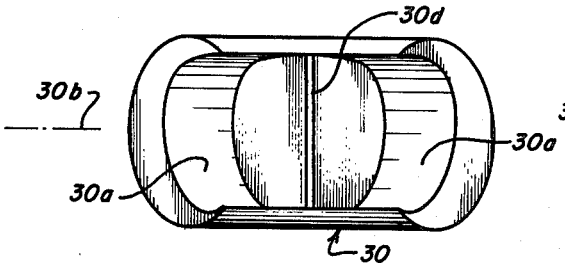
Figure 7:
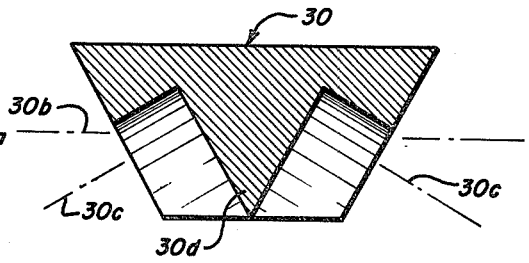

The illustrated bearing piece 30, shown in FIGS. 5, 6 and 7, is a single structure that provides two slotted bearing surfaces **30*a*, 30*a* for each rotor arm 24. The bearing piece is illustrated as a portion of a cylinder with the cylindrical outer surface apertured adjacent each axial end by a bearing surface 30***a*. Note that the axes 30*c*, 30*c* of the two bearing surfaces are angularly offset from each other and from the cylindrical axis 30*b* of the body of the bearing piece. A bearing stop 30*d* forms a wall which limits the axial depth of each bearing surface 30*a*, 30*a*. This bearing wall can be located to axially position a trunion ring relative to a rotor arm.

The bearing piece 30 is fitted within the bearing seat 24*f* at the end of a rotor arm with each bearing surface 30*a*—30*a* thereof facing and open to the slot 32 of that arm. FIG. 3, on the left side, shows a rotor arm prior to assembly of the bearing piece therein, and shows, on the right side, an identical rotor arm 24 with a bearing piece 30 fitted therein. The bearing surface 30*a* of a bearing piece installed in a rotor arm preferably provides, as shown in the right side of FIG. 3, a trough-like pin-seating recess 38 at the outer end of the slot 32. This recess or depression biases a trunion pin to remain seated in the bearing, even when the rotor is stationary. The illustrated bearing piece 30 provides this recess with bearing surfaces 30*a*, 30*a* that are inclined by a small angle as shown in FIG. 3, and that are offset below the center of the slot 32.

The assembly of a bearing piece 30 with a rotor arm 24 preferably is carried out by spreading apart the upper element 24*a* and lower element 24*b* of that arm, to open the bearing seat so that it receives the bearing piece without interference. The jaws of a spreading tool or similar device (not shown) are readily inserted into the slot 32 of an arm and forced apart to spread the upper and lower elements sufficiently to receive the bearing piece. The spreading deflection of the arm elements is within the material elastic limits so that upon removal of the spreading force the arm elements elastically return to their normal configuration and thereupon compressively clamp the bearing piece securely in place in the bearing seat.

Figure 2:
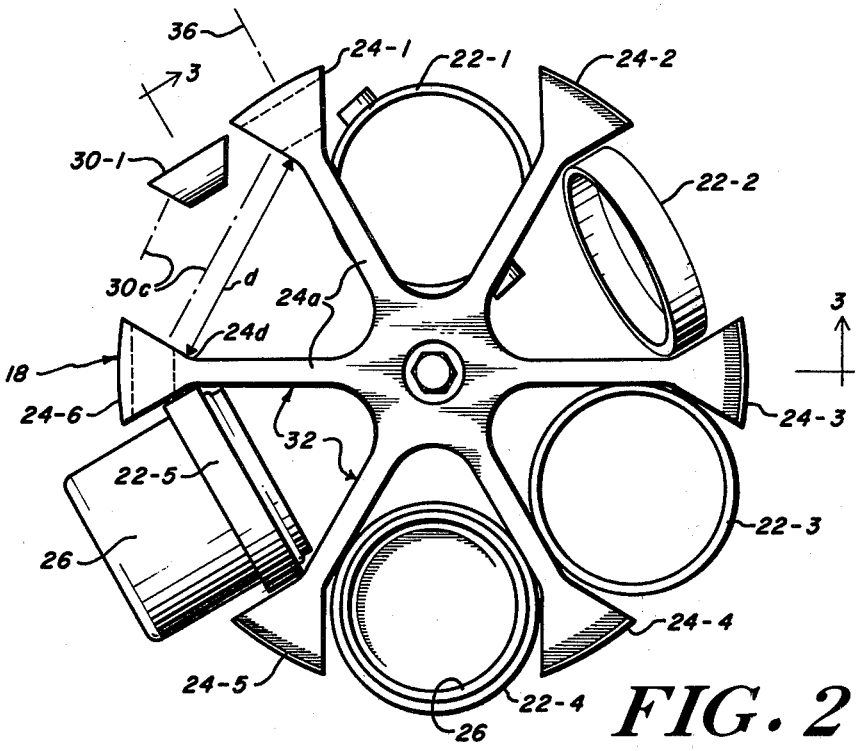
FIG. 2 is a fragmentary plan view of the rotor assembly of FIG. 1 with different rotor arms at different stages of assembly or operation.

FIG. 2 shows several stages in the assembly of a rotor assembly 10 according to the invention. The rotor arm 24-1 is to be fitted with a bearing piece 30-1. Upon assembly, the center line 30*b* of the bearing piece 30-1 is transverse to the center line 36 of the rotor arm 24-1. The bearing surface axis 30*c* of the bearing piece thus seated in the arm 24-1 and which faces the counterclockwise adjacent arm 24-6 is aligned with the corresponding axis of the opposed bearing surface in the latter arm. The illustrated provision of a separate bearing liner piece 30 in the bearing element 24*c* of a rotor arm is considered preferable, but may not be required for all practices of the invention. A rotor arm of suitable material can provide the trunion bearing without such an insert.

Figure 8:
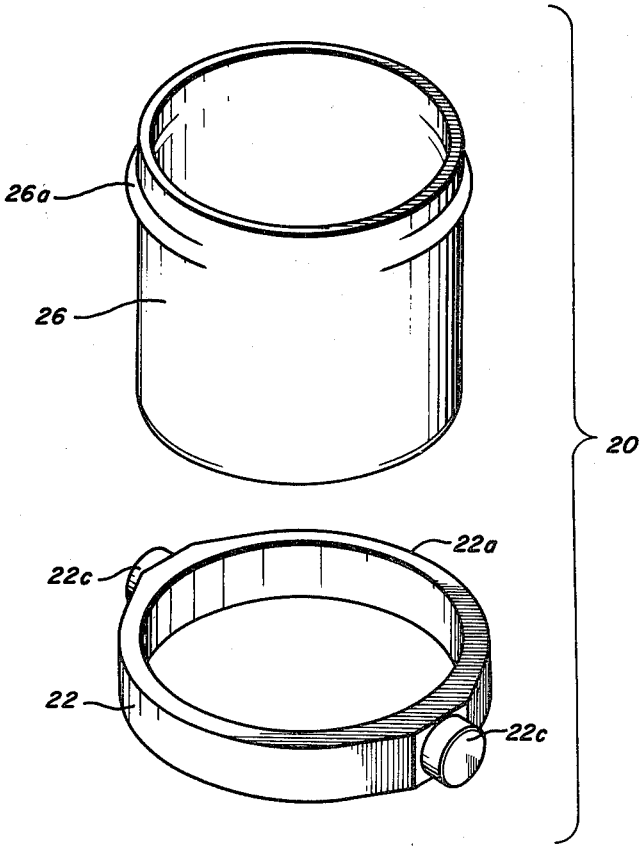
FIG. 8 is an exploded view of a trunion ring and a centrifuge receptacle that form a centrifuge carrier for one practice of the invention.

FIG. 8 shows a trunion ring 22 and a centrifuge receptacle 26 that together form one centriguge carrier 20 as illustrated in FIG. 1. The trunion ring 22 has a sleeve 22*a* of a relatively short axial length and has a cylindrical inner surface 22*b*. Trunion pins 22*c*—22*c* project radially outward in opposite directions along a common diameter from the sleeve outer surface. The trunion ring outer surface is also generally cylindrical with the addition of a strengthening boss at the juncture of each trunion pin 22*c* with the ring. In the preferred illustrated embodiment, the axial length of the sleeve 22*a* is essentially the same as the outer diameter of each trunion pin 22*c*, and the slot 32 in each rotor arm 24 is dimensioned slightly wider to receive and guide the sleeve and pin without interference. Alternative to the illustrated structure, the invention can be practiced with a trunion element of non-circular shape.

The illustrated receptacle 26 is a hollow, cylindrical can with a closed flat bottom. The receptacle has an outer surface dimensioned for a close clearance fit within the inner surface of the trunion ring 22, as appears in FIG. 1. A radial enlargement 26*a* on the receptacle outer surface, illustrated as a circular rim projecting radially outward adjacent the receptacle upper end, seats on the flat upper annular surface of the trunion ring to limit the penetration of the receptacle into the ring, as appears in FIG. 1. The receptacle 26 can, where desired, be provided with a lid or other closure. The centrifuge carrier 20 can, as one illustrative alternative arrangement, provide multiple compartments rather than a single compartment, to carry multiple specimens, as is common in the centrifuge art. Further, although considered less desirable, the carrier can have a unitary construction with a rim-element fitted with pivot pins and supporting a holder element. It thus is to be understood that a carrier 20 can have any of numerous configurations known for centrifuge holders and frames.

With further reference to FIG. 2, a trunion ring 22 according to the invention is assembled with the rotor 18 as illustrated with the trunion ring 22-1 being mounted with the rotor arms 24-1 and 24-2. The trunion ring 22-1 is oriented to offset the axis of the trunion pins from the rotor circumference in order to fit the ring outer diameter between the opposing end-section faces of the arms 24-1 and 24-2, and thereby fit the trunion ring into the slots 32 of these two arms, as shown. The trunion ring 22-1, upon being fitted within the slots as illustrated, is rotated counterclockwise to align one trunion pin thereof in the slot of each arm 24-1 and 24-2. The ring as thus oriented is slid radially outward, with the trunion pins thereof seated within the arm slots, until the trunion pins seat in the bearing elements at the outer ends of the two arms. The trunion rings 22-2 and 22-3 of FIG. 2 are in this position respectively relative to the rotor arms 24-2 and 24-3, and the rotor arms 24-3 and 24-4. These trunion rings are free to pivot or rotate relative to the rotor as apparent from the different relative orientations of the rings 22-2 and 22-3. The tilted orientation of the trunion ring 22-2 further illustrates that when rotated to the position shown, that trunion ring does not interfere with the installation of the adjacent trunion ring 22-1.

The trunion ring 22-4 in FIG. 2 is shown with a receptacle 26 mountingly seated therein. Further, the trunion ring 22-5 and the receptacle 26 seated therein show the outwardly-tilted orientation which each centrifuge carrier normally tends to assume during centrifugal rotation of the rotor assembly of FIG. 1.

The rotor 18 thus is readily loaded with centrifuge carriers 20, and yet holds the carriers secure against accidental dislodgement but free to rotate under centrifugal forces. The rotor can be unloaded with equal ease and facility. For this purpose, the receptacles 26 are lifted out of the trunion rings, and the trunion rings removed from the rotor. The removal sequence simply involves sliding the ring inward along the two slotted arms, rotating the ring to dislodge the trunion pins from the slots, and withdrawing the ring radially outward from between the two arms.

It will thus be seen that the objects set forth above, among those made apparent from the preceding description, are efficiently attained. Since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what is claimed as new and secured by Letters Patent is:

1. In a centrifuge rotor having plural arms extending radially from a hub, said rotor being arranged for supportingly receiving on said arms pivoting support means for centrifuge carrier means, the improvement in which each rotor arm comprises sling means formed by vertically-spaced upper and lower arm segments joined at a sling seat distal from the rotor hub, said segments of each rotor arm being vertically-separated for removably and replaceably receiving therebetween receptacle-supporting pivot structure, and said sling seat forming bearing means for receiving the receptacle-supporting pivot structure.

2. In a rotor according to claim 1, the further improvement in which each rotor arm comprises a unitary rigid structure including an upper arm segment and a lower arm segment, said bearing means includes a bearing insert seatingly compressed within said unitary structure, and said upper and lower arm segments are elastically-deflectable vertically apart for opening said unitary structure sufficiently for relieving the compression on said bearing insert.

3. In a rotor according to claim 1, the further improvement in which each rotor arm has means forming a radially-extending channel-like space aperturing each radially-extending vertical side thereof, said channel-like space including said bearing means at the radially outer end thereof and being arranged for receiving therein the receptacle-supporting pivot structure.

4. Centrifuge rotor apparatus having plural rotor arms extending radially from a hub for supportingly receiving at said arms pivoting support means for at least one centrifuge carrier, said apparatus having the improvement in which at least one said rotor arm comprises A. vertically-spaced upper and lower arm segments, B. bearing means joined between said arm segments at a location distal from the rotor hub, and C. means forming a channel between said vertically-spaced segments of said rotor arm, said channel communicating with the radially inner side of said bearing means for removably and replaceably receiving in said channel, and thereby for seating in and for removing from said bearing means, said pivoting support means.

5. Centrifuge rotor apparatus comprising plural centrifuge carriers each of which has rim means from which two pivot means outwardly project along a common pivot axis and having specimen holder means carried by said rim means, and a rotor radially recessed with plural carrier seats, each carrier seat having means defining a pair of opposed radially-extending channel-like spaces dimensioned for seatingly and retainingly receiving therein opposite edges of said rim means of a carrier positioned in said seat, each said space having means forming a pivotal bearing surface closing the radially outer end of said channel-like space for seatingly receiving one pivot means of said carrier positioned in said seat.

6. Centrifuge rotor apparatus comprising a first plurality of centrifuge carriers, each of which has trunion ring means from which two trunion pins outwardly project along a common axis and specimen holder means supportingly attached to said trunion ring means, and a centrifuge rotor having a first plurality of radially-extending arms projecting from a hub, each said rotor arm including vertically-spaced upper and lower arm segments, each rotor arm having, between said upper and lower arm segments thereof, means forming a radially-extending channel-like space aperturing each radially-extending vertical side thereof for receiving in said channel-like space said trunion means and said pin means, and means joined between said arm segments at a location distal from said hub, and forming bearing means closing the radially outer end of each said channel-like space for seatingly receiving one said trunion pin.

7. Centrifuge rotor apparatus as defined in claim 6 further comprising slot means aperturing each rotor arm between the opposed channel-like spaces thereof.

8. Centrifuge rotor apparatus as defined in claim 7, in which said bearing segment includes means forming a bearing-receiving seat open to said slot means, and wherein said arm segments of each rotor arm are elastically deflectable apart for elastically enlarging said bearing seat.

9. Centrifuge rotor apparatus as defined in claim 6, further comprising means forming a slot aperturing each centrifuge arm and forming said channel-like spaces of said arm.

10. Centrifuge rotor apparatus as defined in claim 8, in which said bearing segment includes means forming a bearing-receiving seat open to said slot means, and wherein said arm segments of each rotor arm are elastically deflectable apart for elastically enlarging said bearing seat.

* * * * *